United States Patent [19]

Turner

[11] 4,395,204

[45] Jul. 26, 1983

[54] OIL WELL PUMP

[76] Inventor: Richard L. Turner, Rte. 2, Box 138, Broken Arrow, Okla. 74012

[21] Appl. No.: 194,781

[22] Filed: Oct. 7, 1980

[51] Int. Cl.[3] ..... F04B 21/04

[52] U.S. Cl. ..... 417/554; 92/185; 277/71

[58] Field of Search ..... 417/554, 559, 557; 92/185, 182, 255, 258; 277/71, 72 R, 73; 137/533.11; 166/325, 328, 329

[56] References Cited

U.S. PATENT DOCUMENTS

| | | | |
|---|---|---|---|
| 1,564,484 | 12/1925 | Kibele | 92/185 |
| 1,713,031 | 5/1929 | Deakins | 92/185 |
| 2,097,629 | 11/1937 | Lowrey | 417/430 |
| 2,295,521 | 9/1942 | Payne et al. | 92/248 |
| 2,392,182 | 1/1946 | Payne | 92/185 |
| 2,462,257 | 2/1949 | Cunningham | 92/252 |
| 3,144,256 | 8/1964 | Wright | 92/250 X |
| 3,947,158 | 3/1976 | Gage | 417/554 |
| 3,953,155 | 4/1976 | Roeder | 92/182 X |
| 4,084,925 | 4/1978 | Stroud et al. | 417/554 |

FOREIGN PATENT DOCUMENTS

| | | | |
|---|---|---|---|
| 1333371 | 6/1963 | France | 277/71 |

*Primary Examiner*—Michael Koczo

*Attorney, Agent, or Firm*—Head, Johnson & Stevenson

[57] ABSTRACT

An oil well subsurface pump comprising a housing for reciprocal disposition within a working barrel and having one end thereof adapted to be secured to the lowermost end of a sucker rod, or the like, and the opposite end thereof in open communication with the fluid reservoir in a well bore, a ball check valve carried by the housing and disposed within a ball chamber having one end closed for limiting the movement of the ball member in one direction and the opposite end open to the well fluid, resilient sealing assembly interposed between the outer periphery of the housing and the inner periphery of the working barrel and slidable with respect to the barrel during a pumping operation, longitudinally disposed passageways provided in the housing and extending from the ball chamber to a position beyond the upper limit of the sealing assembly to provide communication through the housing to the annulus between the housing and the working barrel for passage of the well fluid from the fluid reservoir to the annulus for transportation of the fluid to the surface of the well bore, the sealing assembly comprising a plurality of superimposed flanged rings having sealing members secured around the outer periphery thereof and a locking ring outboard of the flanged rings for securing the flanged rings in position around the outer periphery of the housing.

2 Claims, 8 Drawing Figures

OIL WELL PUMP

CROSS-REFERENCE TO RELATED APPLICATIONS

This application is an improvement of my prior copending application Ser. No. 937,156, filed Aug. 28, 1978, and entitled OIL WELL PUMP, which is now U.S. Pat. No. 4,229,149.

BACKGROUND OF THE INVENTION

1. Field of the Invention

This invention relates to improvements in oil well pumps and more particularly, but not by way of limitation, to a reciprocal subsurface oil well pump of a minimum length and stroke for an efficient pumping operation.

2. Description of the Prior Art

In producing oil wells it is common practice to provide a pump at the bottom of a well bore, or at least down the well bore in the proximity of the producing formation. The pump is normally secured to the lowermost end of the sucker rod string, which extends longitudinally through the well bore from a reciprocating device at the surface of the ground. The reciprocating device at the surface is usually a horsehead type apparatus and alternately raises and lowers the string of sucker rods in the well bore. Subsurface pumps have long presented problems in the lifting of the well fluid to the surface of the ground in that the plunger of the pump is usually several feet long and thus requires a relatively long stroke for operation of the pump. This results in substantially great friction and drag on the pump as the pump plunger reciprocates within the working barrel. As a result, the pump may not move freely and the plunger may not have a full stroke, thus reducing the pumping efficiency. In addition, since most of the subsurface pumps are relatively long, it may require several strokes of the pump before a sufficient load is applied to the pump for starting the pumping action. Also, many well fluids contain sand and other foregoing particles which hinder the operation of the subsurface pump and frequently damage the working parts thereof.

In order to overcome these disadvantages, the pump shown in my aforementioned prior patent was developed, and comprises a relatively short plunger or housing, as for example ten or twelve inches in length, and which is threaded at one end for connection with the lowermost sucker rod for reciprocation thereby within the working barrel. The housing is open at one end for receiving the well fluid therein, and a ball check valve is carried by the housing for intermittently admitting the fluid into the fluid passageways of the housing whereby the well fluid may be lifted to the surface of the well. This pump has certain disadvantages, however, in that the sealing members interposed between the outer periphery of the housing and the inner periphery of the working barrel have proven to be a problem in the operation of the pump, and the stop means for limiting the upward movement of the ball member is frequently damaged by the force with which the ball member strikes the stop.

SUMMARY OF THE INVENTION

The present invention contemplates a novel oil well pump which has been particularly designed and constructed for overcoming the disadvantages of my prior pump and comprising a housing having a reduced neck member at one end provided with an internally threaded bore for connection with the lowermost sucker rod, or the like. An outwardly extending circumferential shoulder is provided around the outer periphery of the neck member for supporting a plurality of superimposed sealing rings having resilient sealing members secured around the outer periphery thereof for sliding engagement with the inner periphery of the working barrel during a pumping operation. A locking ring is threadedly engaged with the outer periphery of the neck member outboard of the sealing rings for securing the sealing rings in position during the pumping operation and providing for ready access to the sealing rings for replacement or repair thereof as required. The opposite end of the housing is provided with a central bore extending longitudinally therein and which is in open communication with the fluid reservoir in the well bore. An inwardly directed annular shoulder is provided on the inner periphery of the central bore for receiving a valve seat thereagainst, and a retainer sleeve is threadedly secured in the bore outboard of the valve seat for securing the valve seat in position. A ball chamber is provided within the housing inboard of the valve seat for loosely receiving a ball member therein, and the inner wall of the chamber is closed for limiting the movement of the ball in a direction away from the valve seat during a pumping operation. A plurality of longitudinally extending passageways are provided in the housing providing communication between the ball chamber and the exterior of the neck portion beyond the outer limit of the locking ring for communication between the fluid reservoir and the annulus between the neck member and the working barrel for transportation of the well fluid to the surface of the well bore. The sealing rings comprise a flange sleeve member of a rigid material having an annular sealing member disposed around the outer periphery thereof, with one end of the sealing member bearing against the flange member of the sleeve. The outer periphery of the sealing member slides against the inner periphery of the working barrel during a pumping operation for precluding leakage of fluid between the housing and working barrel to assure an efficient pumping action, and are particularly designed for precluding loss of the sealing member and galling of the resilient material from which the sealing members are constructed. The novel pump is simple and efficient in operation and economical and durable in construction.

DETAILED DESCRIPTION OF THE PREFERRED EMBODIMENT

Figure 1:
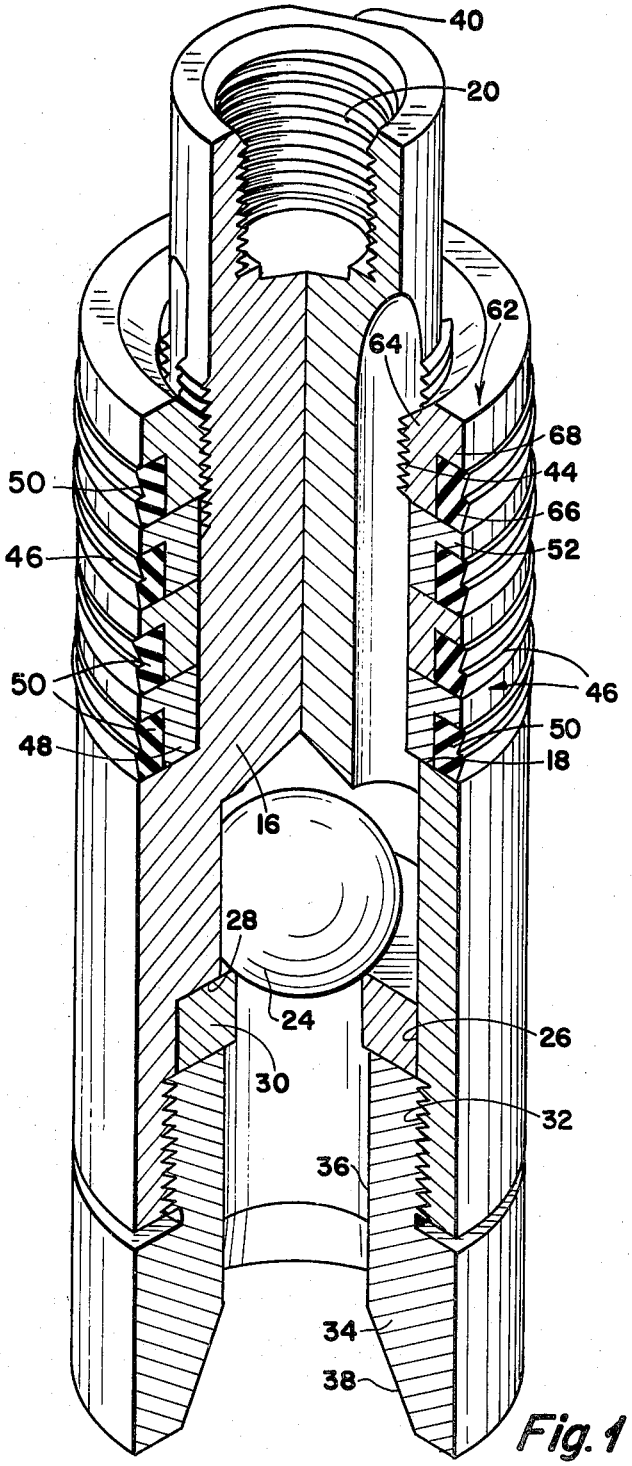
FIG. 1 is a cut-away perspective view of an oil well pump embodying the invention.

Referring to the drawings in detail, reference character 10 generally indicates a subsurface oil well pump comprising a pump housing 12 adapted to be reciprocally disposed within a working barrel 14, or the like, normally present in a producing oil well bore (not shown). The working barrel 14 is preferably set within a well buting (not shown) by a suitable packer (not shown), or the like, as is well known and in such a manner that the pump 10 is disposed in the proximity of or within the producing subsurface formation (not shown) of the well bore (not shown). However, it is to be noted that it may be desirable to retain the pump assembly 10 stationary and reciprocate the working barrel 14 with respect thereto during the pumping operation.

The pump housing 12 is providing with a reduced diameter stem 16 extending axially outwardly therefrom providing an annular shoulder 18 around the outer periphery thereof and having a longitudinally extending threaded bore 20 provided at the outer end thereof for threaded connection with the lowermost sucker rod (not shown) of the sucker rod string extending through the working barrel 14, as is well known. The opposite end of the housing 12 is provided with a centrally disposed longitudinally extending bore 22 therein providing a chamber for receiving a freely movable ball member 24 therein. The bore 22 is engaged at 26 to provide an annular shoulder 28 for receiving a suitable annular valve seat 30 thereagainst for retaining the ball 24 within the chamber or bore 22. The bore 26 is provided with a threaded portion 32 for threadedly receiving a follower sleeve 34 therein which engages the outer face of the valve seat 30 for securely retaining the valve seat 30 in position within the bore 26. The sleeve 34 is provided with an internal passageway 36 providing communication between the interior of the working barrel 14 and the chamber 22 for direction well fluid (not shown) into the chamber 22 during operation of the pump 10 as will be hereinafter set forth. The passageway 36 is prefereable bevelled or outwardly tapered at the outer end thereof as shown at 38 for facilitating the passage of the well fluid from the well bore into the chamber 22. In addition, it is preferable to provide a pair of oppositely disposed "flats" 40 and 42 on the outer periphery of the sleeve 34 for facilitating installation and removal of the sleeve from the threaded bore 32, as is well known. Similar oppositely disposed "flats" 41 and 43 are provided in the outer periphery of the stem 16 for the same purpose.

The stem 16 is provided with a threaded portion 44 interposed between the outer end thereof and the shoulder 18 for a purpose as will be hereinafter set forth. A plurality of packing ring assemblies 46 are disposed around the outer periphery of the stem 16 with the lowermost packing ring assembly 46 being supported by the shoulder 18 and the remaining assemblies 46 being superimposed above the lowermost ring, as clearly shown in FIGS. 1 and 2. Each packing ring assembly 46 is preferably substantially identical and comprises a flanged sleeve member 48 having a resilient or yieldable sealing ring 50 disposed around the outer periphery thereof. One end of the sealing ring 50 bears against the outwardly extending circumferential flange 52 of the sleeve 48 and the opposite end of the ring 50 is substantially co-planar with the opposite end of the sleeve 48.

Figure 5:
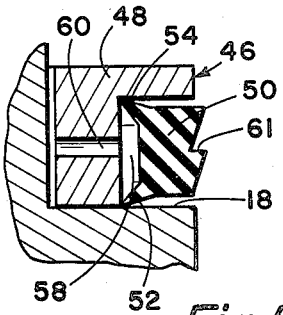
FIG. 5 is an enlarged sectional view of a portion of a sealing member utilized in an oil well pump embodying the invention.
Figure 6:
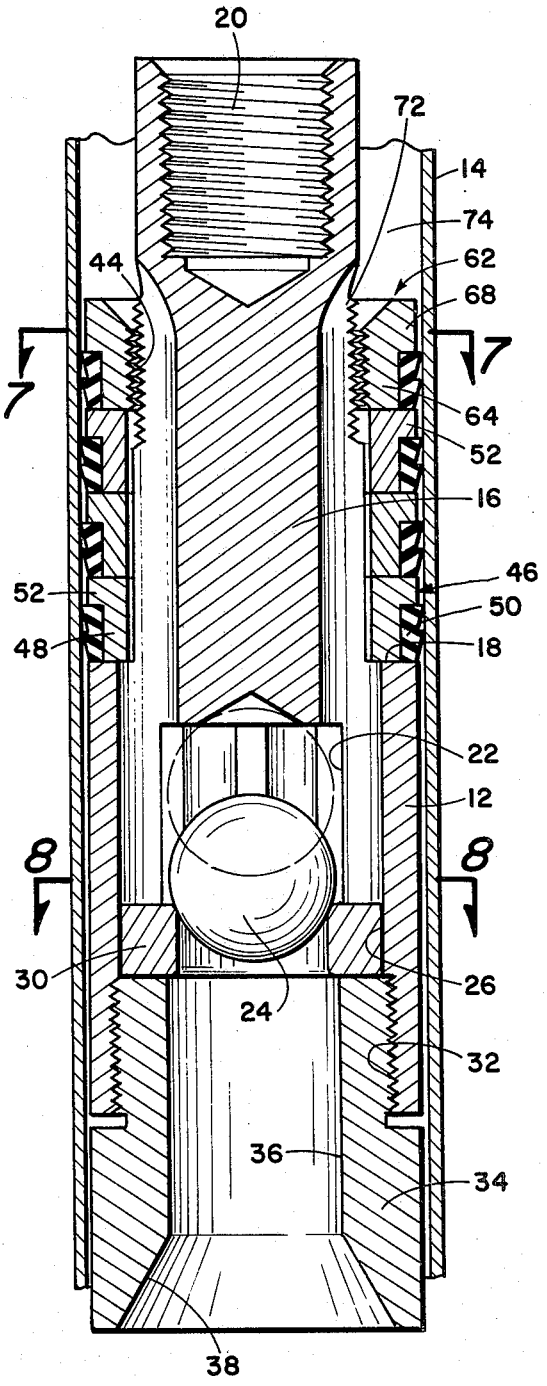
FIG. 6 is a view similar to FIG. 1, and taken at a ninety degree angular orientation with respect thereto.
Figure 7:
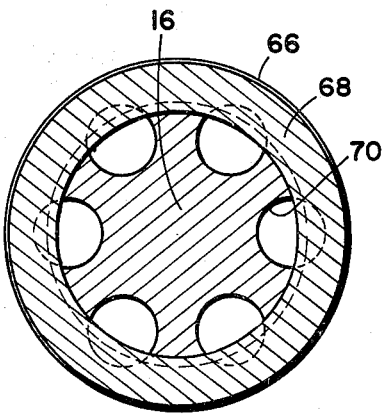
FIG. 7 is a view taken on line 7—7 of FIG. 6.
Figure 8:
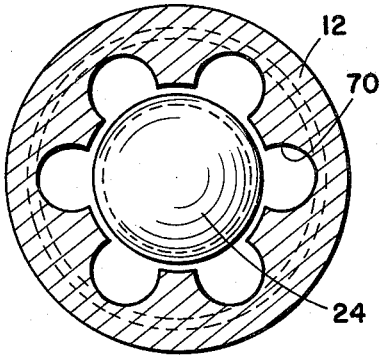
FIG. 8 is a view taken on line 8—8 of FIG. 6.

Whereas the inner periphery of the sealing ring 50 may be substantially cylindrical, or provided with substantially straight axially extending sidewalls, it is preferable to provide a pair of oppositely disposed angularly outwardly extending annular flanges 54 and 56 (FIG. 5) on the inner periphery of the sealing ring 50 to provide a relatively small annular chamber 58 between the outer periphery of the sleeve 48 and the inner periphery of the sealing ring 50. In this instance, it is also preferable to provide a plurality of radially extending, circumferentially spaced parts or bores 60 which are in communication with the chamber 58 and the interior of the sleeve 48. Thus, any fluid which may accumulate between the outer periphery of the stem 16 and the inner periphery of the sleeve 48 may pass through the bore 60 and into the chamber 58 for exerting pressure against the inner periphery of the sealing ring 50 to facilitate the sealing qualities thereof as will be hereinafter set forth.

The outer periphery of the sealing ring 50 is preferably of a stepped configuration, with the upper end of the uncompressed ring as viewed in the drawings being of a slightly greater outer diameter than the outer diameter of the adjacent flange 52 and tapered radially inwardly substantially one-half the longitudinal length of the ring. An outwardly extending circumferential shoulder 61 is provided at the lower limit of the inwardly directed taper, said shoulder 61 preferably having an outer diameter substantially equal to the outer diameter of the upper end of the ring 50. The body of the ring 50 is preferably tapered radially inwardly from the outer limit of the shoulder 61 of the bottom of the ring 50 as viewed in the drawings. This configuration has been found to provide an efficient sealing and long life for the sealing members 50, thus reducing "down time" during operation of the pump 10.

A follower assembly 62 is threadedly secured to the threaded portion 44 outboard of the outermost packing ring assembly 46 for securely retaining the assemblies 46 in position around the stem 16, as is well known. The follower assembly 62 comprises a flanged sleeve 64 generally similar to the sleeves 48 and having the inner periphery thereof threaded for engagement with the threads 44. A sealing ring 66 which is preferably substantially identical to the sealing rings 50 is disposed around the outer periphery of the sleeve 64, with one end of the sealing ring 66 bearing against the circumferential shoulder 68 of the sleeve 64 and the opposite end thereof being substantially co-planar with the lower end of the sleeve 64 as particularly shown in FIG. 2. The sealing ring 66 may be provided with a chamber (not shown) similar to the chamber 58 around the inner periphery thereof, if desired, and the sleeve 64 may be provided with a plurality of circumferentially spaced bores (not shown) similar to the bores 50, if desired, for the purpose as hereinbefore set forth.

The housing 12 is provided with a plurality of circumferentially spaced passageways 70 which extend longitudinally from the chamber 22 to an outlet 72 disposed outboard of the follower assembly 62. In this manner a fluid passageway is provided for directing fluid from the chamber 22 to an annulus 74 between the stem 16 and working barrel 14 and into the interior of the working barrel 14 above the pump assembly 10.

In operation, the stem 16 is threadedly secured at 20 to the lowermost sucker rod (not shown) as is well known thus suspending the pump 10 within the well bore (not shown) for reciprocation within the barrel 14 simultaneously with the sucker rod string (not shown).

Figure 2:
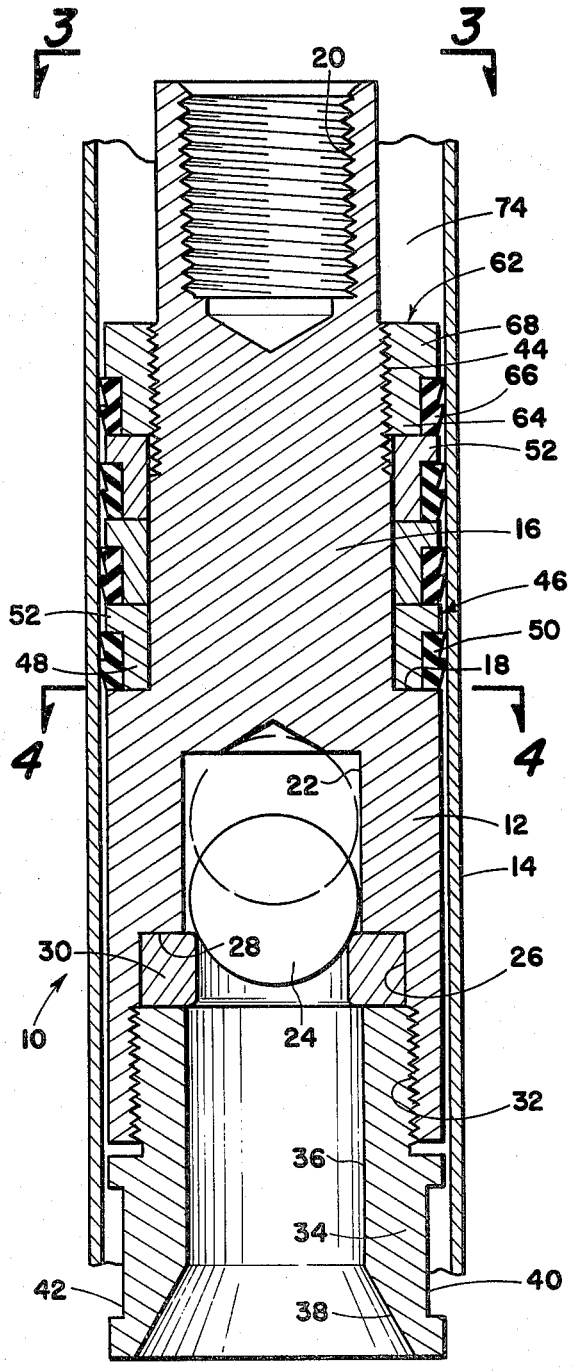
FIG. 2 is a sectional elevational view of an oil well pump embodying the invention.
Figure 3:
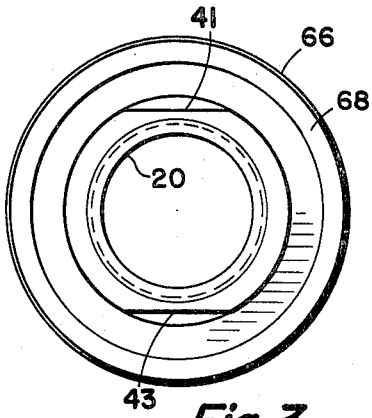
FIG. 3 is a view taken on line 3—3 of FIG. 2.
Figure 4:
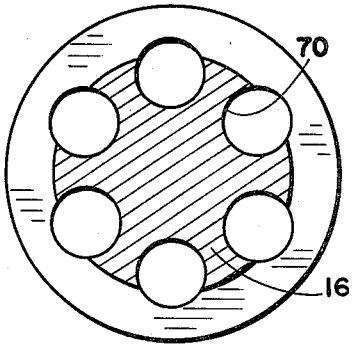
FIG. 4 is a view taken on line 4—4 of FIG. 2.

As the pump 10 travels downwardly in the well bore, the ball member 24 is moved upwardly within the housing 12 by the well fluid and to the position shown in broken lines in FIG. 2. In this position, the well fluid may enter the chamber 22 and move freely around the ball 24 for movement upwardly through the passageway 70 for discharge through the outlet ports 72 into the annular space or annulus 74. Of course, the upward movement of the ball 24 is limited by the engagement thereof with the closed end of the chamber 22.

On the upstroke, the sealing members 50 which are in sealing engagement with the inner periphery of the working barrel 14 and move the fluid contained in the annulus 74 upwardly in the well bore. Simultaneously a vacuum is created in the passageway 36 and the ball member 24 is moved to the position of engagement with the valve seat 30 as shown in solid lines in FIG. 2. The vacuum permits an added "load" or additional quantity of well fluid to move into the passageway 36 during the next succeeding downstroke of the pump 10, and of course repeated reciprocation of the pump 10 within the barrel 12 causes the well fluid to move upwardly through the well bore for recovery at the surface of the well bore.

In the event the sealing members 50 become worn or otherwise damaged, the follower assembly 62 may be readily removed from the threaded engagement with the stem 16 for facilitating removal and/or replacement of any of the sealing members. In addition, the stepped configuration of the outer periphery of the sealing members 50 provides a flexibility for the rings 50 during the reciprocation of the assembly 10 whereby an efficient sealing is provided between the barrel 14 and housing 12 during operation of the pump with a minimum of wear on the resilient sealing ring, thus providing an increased useful life for the sealing members. As a result the pump assembly 10 functions efficiently through a relatively long working period, which reduces the overall cost of operation, and provides a pumping action of great efficiency in elevating well fluid to the surface of the well at a relatively great pumping rate.

From the foregoing it will be apparent that the present invention provides a novel subsurface oil well pump of a relatively short overall length, and having efficient sealing rings disposed thereon which are readily accessible for repair of replacement. In addition, the pump housing is particularly designed for reducing or eliminating damage to the barrel during opening of the ball valve, and the sealing rings are provided with a flanged sleeve having a resilient sealing member secured around the outer periphery thereof whereby strength and efficient sealing qualities are provided for the sealing members. The overall useful life of the pump is greatly increased by the improved design of the sealing rings and solidity of the housing for reducing damage from engagement thereof by the ball member.

Whereas the present invention has been described in particular relation to the drawings attached hereto, it should be understood that other and further modifications, apart from those shown or suggested herein may be made within the spirit and scope of this invention.

What is claimed is:

1. A subsurface well pump for disposition within a working barrel of a well bore and arranged for reciprocal movement therebetween, said pump comprising housing means having a chamber provided in one end thereof in communication with a well fluid reservoir, ball check valve means secured to the housing means and disposed in the chamber to provide alternate open and closed positions for the pump during operation thereof, said chamber having one end thereof closed for limiting the movement of the ball in one direction during opening of the ball check valve means, passageway means provided in said housing means and having one end in communication with the chamber and the opposite end open to an annulus between the housing means and the working barrel for elevation of the well fluid to the surface of the well during operation of the pump, sealing means removably secured to the outer periphery of the housing means above the closed end of the chamber and in sealing engagement with the outer periphery of the housing means and the inner periphery of the working barrel for sealing the annulus from the well fluid reservoir, said sealing means comprising a plurality of substantially identical sealing ring assemblies disposed in stacked relation around the outer periphery of the housing means, each of said sealing ring assemblies comprising a flanged sleeve disposed around the outer periphery of the housing means and having a resilient sealing member secured around the outer periphery thereof for sealing engagement with the inner periphery of the working barrel, and follower assembly means removably secured to the housing means and engagable with the uppermost sealing ring assembly for securely locking the sealing ring assemblies around the housing means, and wherein the outer periphery of the resilient sealing members is of a stepped configuration for an efficient sealing with reduced wear of the sealing members, and wherein the resilient sealing members are provided with an annular chamber around the inner periphery thereof for receiving fluid therein to enhance the sealing qualities thereof, and wherein the flanged sleeves are provided with a plurality of circumferentially spaced radially extending bores in communication with the chamber of the sealing rings for directing fluid thereto, and said housing means is provided with longitudinally extending passageways cooperating with the radially extending bores to provide fluid inlet passages for the chamber of the sealing rings.

2. A subsurface well pump as set forth in claim 1 wherein the housing means comprises a body member having a reduced diameter stem extending axially outwardly therefrom for receiving the sealing ring assemblies therearound and providing an annular shoulder for receiving the lowermost sealing ring assemblies thereon for supporting the stacked sealing ring assemblies, said stem having a threaded portion on the outer periphery thereof for receiving the locking means thereon.

* * * * *